US006992632B1

(12) United States Patent
Mohuchy

(10) Patent No.: US 6,992,632 B1
(45) Date of Patent: Jan. 31, 2006

(54) LOW PROFILE POLARIZATION-DIVERSE HERRINGBONE PHASED ARRAY

(75) Inventor: Wolodymyr Mohuchy, Nutley, NJ (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 23 days.

(21) Appl. No.: 10/797,165

(22) Filed: Mar. 9, 2004

(51) Int. Cl.
*H01Q 9/28* (2006.01)
*H01Q 1/38* (2006.01)

(52) U.S. Cl. ..... 343/700 MS; 343/846; 343/795

(58) Field of Classification Search ..... 343/700 MS, 343/846, 853, 854, 795, 803, 850, 810, 811; H01Q 9/28, H01Q 1/38
See application file for complete search history.

(56) References Cited

U.S. PATENT DOCUMENTS 4,063,245 A * 12/1977 James et al. ..... 343/700 MS
4,978,965 A 12/1990 Mohuchy
5,563,616 A 10/1996 Dempsey et al.
5,589,842 A 12/1996 Wang et al.
5,933,108 A 8/1999 Mohuchy
6,133,888 A 10/2000 Mohuchy
6,285,325 B1 * 9/2001 Nalbandian et al. . 343/700 MS
6,392,599 B1 * 5/2002 Ganeshmoorthy et al. ..... 343/700 MS
6,400,332 B1 * 6/2002 Tsai et al. ..... 343/795
6,424,298 B1 * 7/2002 Nishikawa et al. .. 343/700 MS

* cited by examiner

*Primary Examiner*—Hoanganh Le
(74) *Attorney, Agent, or Firm*—RatnerPrestia

(57) ABSTRACT

A phased array antenna includes a plurality of radiating elements arranged as orthogonal pairs in a herringbone pattern. Each radiating element includes multiple microstrips disposed conformally on a planar substrate. Each radiating element includes a dipole formed as a pair of dipole microstrips extending from a pair of launch points. Each dipole microstrip extends between one launch point of the pair of launch points and a top loading microstrip, which provides a capacitive load to the dipole. The top loading microstrip extends between parallel microstrips, which provide an additional capacitive load to the dipole.

25 Claims, 5 Drawing Sheets

LOW PROFILE POLARIZATION-DIVERSE HERRINGBONE PHASED ARRAY

FIELD OF THE INVENTION

The present invention relates, in general, to an antenna and, more specifically, to a phased array antenna including multiple radiating elements arranged in a herringbone pattern. The phased array antenna operates over multi-octave bandwidths, subtends a wide field-of-view, and is capable of producing any desired polarization in space.

BACKGROUND OF THE INVENTION

Modern phased array systems are required to operate over wide frequency bandwidths with a single radiating aperture. In such broad band environments, processing functions that have previously been performed by individual antennas, need now to be performed by a single phased array.

A critical parameter of many RF signals is their polarization, requiring an array to respond to any linear, circular or elliptical polarization. This in the art is known as polarization diversity or polarization agility. Antenna polarization agility may be achieved with orthogonally disposed pairs of radiating elements that are electronically processed via a vector controller. Such a vector controller is described by Mohuchy in U.S. Pat. No. 5,933,108, issued Aug. 3, 1999 and is entitled "Gallium Arsenide Based Vector Controller for Microwave Circuits", the disclosure of which is incorporated herein by reference. Polarization agility of a phased array is in much demand.

Significant advances in broadband solid-state power generation has also placed a new emphasis on phased arrays to efficiently combine the power of individual devices into high-power transmissions by exploiting a magnification property known as the "array factor". Commensurate with this trend, demands for high transmitted effective radiated power (ERP) have increased. In addition, operating frequency range has been lowered into the HF/VHF region.

Dimensions of an antenna are inversely proportional to its operating frequency and wavelength, typically measured in tens of feet at HF/VHF frequencies. Consequently, size and weight of low-frequency antenna systems are of concern. This concern is particularly acute in mobile installations on aircraft, ground vehicles and even ships. To circumvent these limitations, shortened and inefficient antennas have been developed, which produced undesirable radiation performance and caused significant secondary inefficiencies in power and heat generation. More efficient radiators have been developed, such as Log-Periodic or Yagi arrays, which require considerable volume and are useable with the so called "big-bottle" transmitters. These radiators have limitations in broadband array applications, due to their element size that is incompatible with grating lobe suppression.

Conventional efforts on size reduction primarily addresses the microwave frequency region. A representative effort is disclosed by Wang et al. in U.S. Pat. No. 5,589,842, issued Dec. 31, 1996, which is entitled "Compact Microstrip Antenna with Magnetic Substrate". Wang et al. disclose different planar radiators which typically are cavity backed for deployment on metallic surfaces. Although Wang et al. deal with arraying elements in circular disposition, they do not deal with any limitations brought about by grating lobe issues.

Dempsey et al. in U.S. Pat. No. 5,563,616, issued Oct. 8, 1996, which is entitled "Antenna Design using a High Index Low Loss Material", disclose a high index of refraction medium having high matched values of relative permeability and relative permittivity. The Dempsey et al. approach favors the VHF frequency region. Applying their approach at HF frequencies, however, when deploying a polarization-diverse phased array, results in an antenna depth that far exceeds the space availability on most mobile platforms.

A need exists to drastically reduce the size of HF/VHF radiating elements, both in surface area and in depth. A need also exists to further decrease the element surface area of an array, while improving impedance characteristics of the array. Yet another need exists to improve the polarization capability of the array at HF/VHF frequencies. The present invention addresses these needs.

SUMMARY OF THE INVENTION

To meet this and other needs, and in view of its purposes, the present invention provides a phased array antenna including a plurality of radiating elements arranged as orthogonal pairs in a herringbone pattern. Each radiating element includes multiple microstrips disposed conformally on a planar substrate. Each radiating element includes a dipole formed as a pair of dipole microstrips extending from a pair of launch points. Each dipole microstrip extends between one launch point of the pair of launch points and a top loading microstrip, which provides a capacitive load to the dipole. The top loading microstrip extends between parallel microstrips, which provide an additional capacitive load to the dipole.

The multiple microstrips of the present invention are disposed approximately one-quarter wavelength above a ground plane. The planar substrate of the present invention is mounted on a composite substrate having a permittivity and permeability matched at a mid-band frequency of operation to achieve an impedance of approximately 377 ohms. The composite substrate is approximately 1/16 of a wavelength in thickness. The composite substrate includes an effective dielectric constant of approximately 10.

The composite substrate of the invention is mounted on a dielectric substrate having a dielectric constant value of approximately 98. The dielectric substrate is approximately 3/16 of a wavelength in thickness. Both the dielectric substrate and the composite substrate have an approximate thickness of 1/4 of a wavelength and yield an approximate thickness reduction ratio of 6.6 to 1.

Another embodiment of the invention provides an antenna system including a phased array formed of a plurality of radiating elements arranged in a herringbone pattern, wherein the radiating elements are formed of multiple microstrips disposed conformally on a planar substrate. A transmit/receive network is connected to the radiating elements for varying the amplitude and phase of a transmitted signal. The transmit/receive network includes a receiver for determining direction and phase of a received signal, and a processor for controlling the amplitude and phase of the transmitted signal based on the direction and phase of the received signal. The transmit/receive network includes an array of modular transmitters for exciting a corresponding array of the radiating elements.

Yet another embodiment of the invention provides a method of making a phased array antenna. The method includes the steps of: (a) conformally forming multiple microstrips on a planar substrate, (b) arranging the multiple microstrips in a herringbone pattern, and (c) placing the multiple microstrips of the planar substrate approximately one quarter of a wavelength above a ground plane. The method also includes the step of: placing a composite substrate and a dielectric substrate between the planar substrate and the ground plane, wherein the composite substrate has an effective dielectric constant of approximately 10 and the dielectric substrate has an effective dielectric constant of approximately 98. The composite substrate is made approximately 1/16 of a wavelength in thickness, and the dielectric substrate is made approximately 3/16 of a wavelength in thickness.

It is understood that the foregoing general description and the following detailed description are exemplary, but are not restrictive, of the invention.

BRIEF DESCRIPTION OF THE DRAWING

The invention is best understood from the following detailed description when read in connection with the accompanying drawing. Included in the drawing are the following figures.

DETAILED DESCRIPTION OF THE INVENTION

Figure 1:
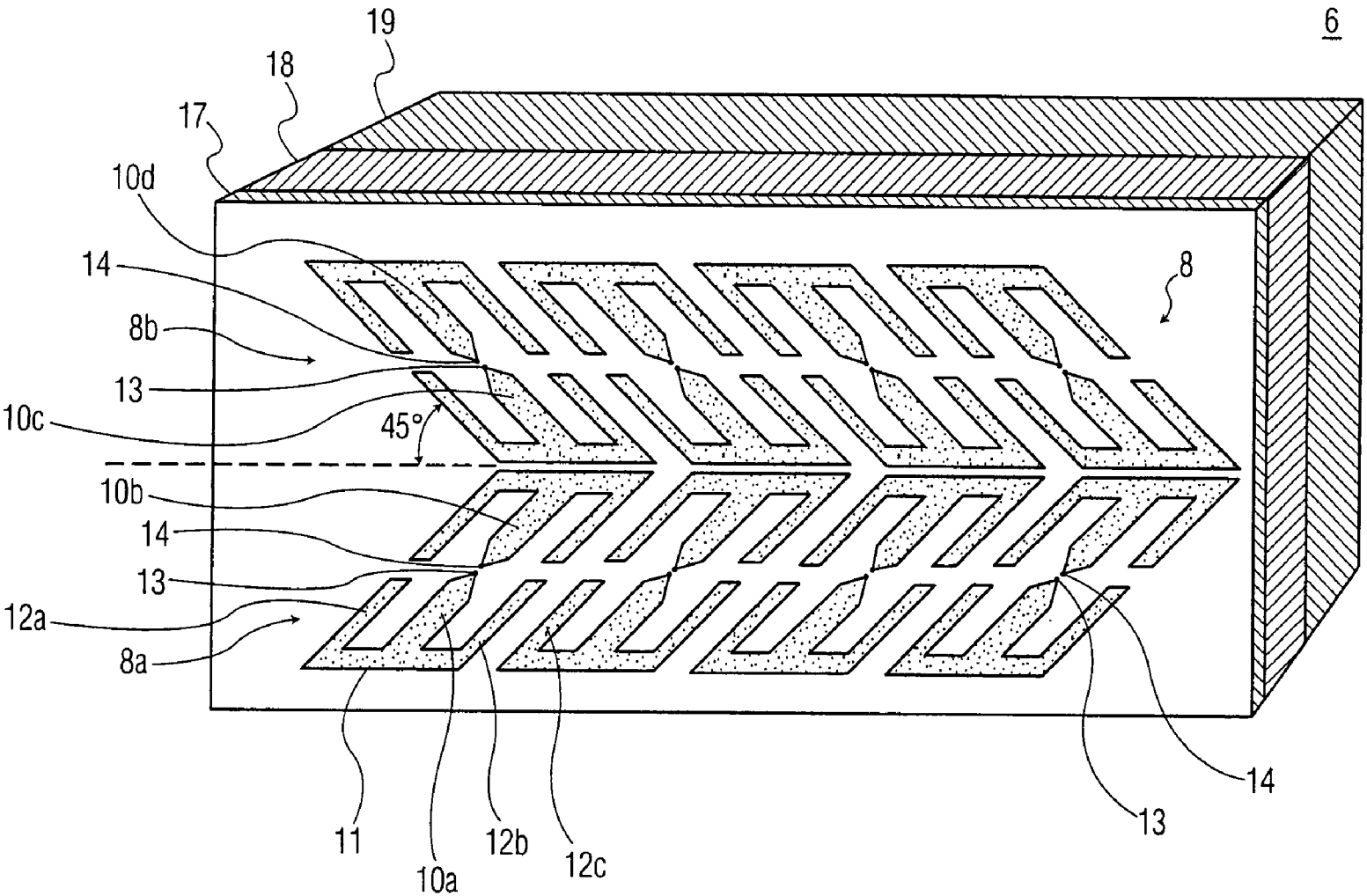
FIG. 1 is a perspective view of multiple radiating elements configured in a herringbone pattern that are conformally mounted as microstrips on a multilayer substrate to form a planar phased array, according to an embodiment of the present invention.

Referring to FIG. 1, there is shown a partial perspective view of a phased array antenna, in accordance with an embodiment of the invention. As shown, phased array antenna 6 includes multiple radiating elements 8, which are arranged as orthogonal pairs in a herringbone pattern. Each orthogonal pair of radiating elements includes multiple microstrips that are formed conformally on a thin substrate. The substrate is generally designated as 17. The orthogonal pairs of radiating elements 8 are positioned 45 degrees relative to a scan axis of the phased array antenna.

Each radiating element 8 includes a dipole formed from a pair of dipole microstrips, generally designated as 10*a* and 10*b*. Each dipole microstrip of the pair of dipole microstrips extends from launch point 13 or launch point 14. In this manner, each dipole is excited or fed in a balanced mode, at feed points or launch points 13 and 14. For discussion purpose only, FIG. 1 shows 8 radiating elements or 8 dipoles, each having launch points 13 and 14. The phased array antenna may include more or less than 8 dipoles.

Dipole microstrip 10*a*, for example, extends between launch point 13 and top loading microstrip 11, the latter providing additional capacitance and a lowered Q for broadening the operational bandwidth of the dipole. Similarly, dipole microstrip 10*b* extends between launch point 14 and another top loading microstrip (not labeled). Top loading microstrip 11 extends between parallel microstrips 12*a* and 12*b*, which are parallel to dipole microstrip 10*a*. Parallel microstrips 12*a* and 12*b* provide additional capacitance and effective line stretching at lower frequencies of operation.

Parallel microstrips 12*a* and 12*b* may be tightly coupled to adjacent radiating elements. For example, as shown in FIG. 1, parallel microstrip 12*b* is tightly coupled to parallel microstrip 12*c*, which forms one of another set of parallel microstrips of an adjacent radiating element (not separately labeled). The parallel microstrips may be meandered or interleaved for further coupling enhancement. Due to the tight mutual coupling, each dipole is effectively electrically longer at the lower end of the frequency band. The planar topography of the microstrips, shown in FIG. 1, and their tight coupling, in essence, forms a current sheet across the antenna array and significantly increases the operational bandwidth of the array.

The microstrips forming multiple radiating elements 8 may be produced by etching a conventional thin microstrip substrate 17. Such microstrip substrate may be, for example, a Rogers 4000 series substrate, which is amenable to conventional processing methods.

Figure 2:
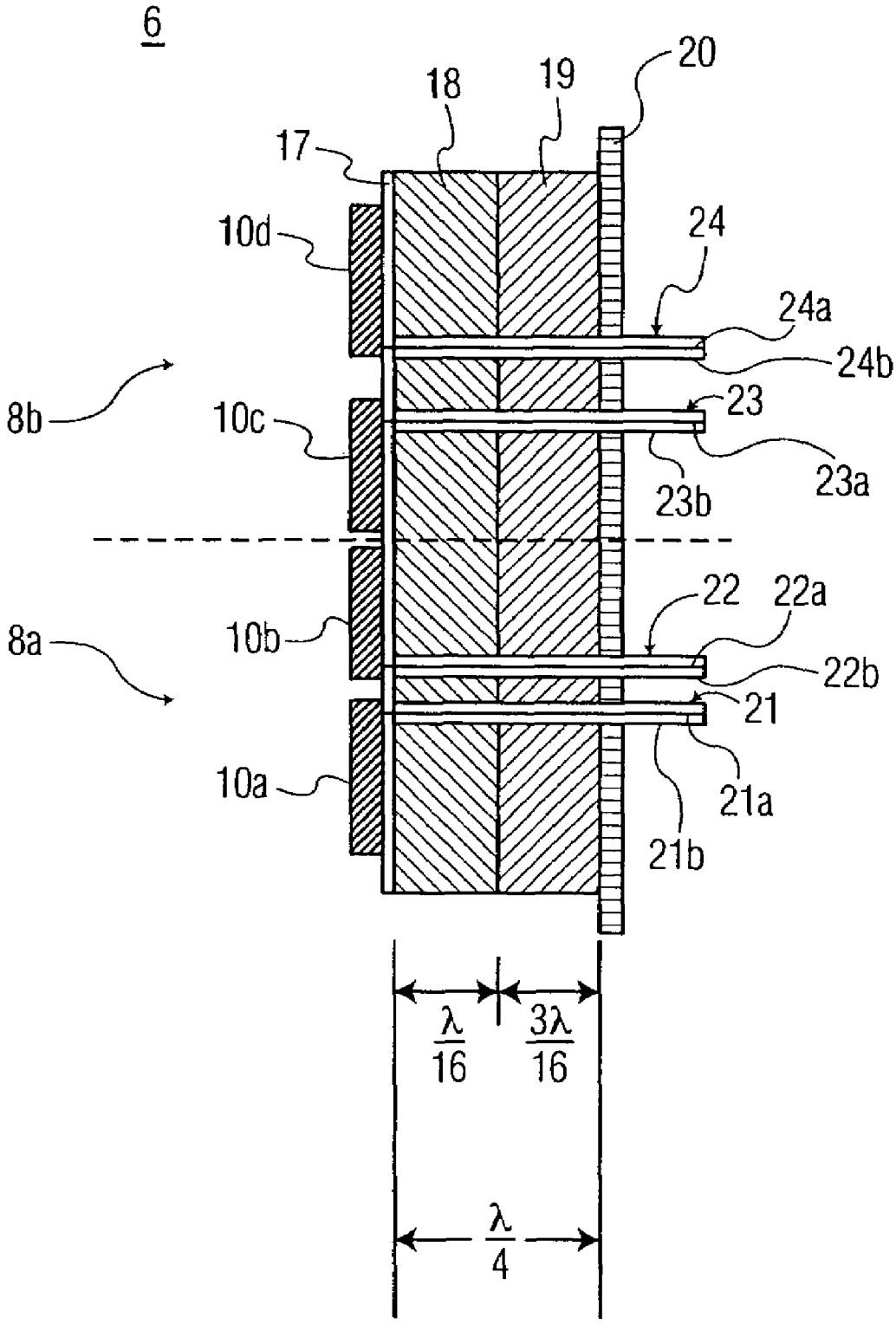
FIG. 2 is a cross-sectional view along a central portion of a pair of radiating elements, or a pair of radiating dipoles, of the planar phased array shown in FIG. 1, in accordance with an embodiment of the invention.

As best shown in FIG. 2, along a cross-sectional view of dipole microstrips 10*a*, 10*b*, 10*c* and 10*d* of FIG. 1, the dipole microstrips are formed on thin substrate 17. It will be appreciated that the dipole microstrips, as well as the top loading microstrips and the parallel microstrips, may be formed by etching standard thin substrate 17 for low power applications. If the radiated power is excessive, however, all the microstrips may be formed from solid metal strips.

The planar microstrips of the invention may typically be placed approximately one-quarter of a wavelength ($\lambda/4$) above ground plane 20. The ground plane may be the metallic surface of a vehicle. In this manner, reflected backscatter energy from the metallic surface of the vehicle, or ground plane 20, may recombine in-phase with the radiated signal from the dipole microstrips. Significant departure from this condition not only causes signal degradation, but in the limit, may entirely cancel radiation in the desired direction and may generate an undesirable surface wave. It is important, therefore, to form the electrical quarter-wave condition with minimum physical depth over a broad bandwidth.

The inventive compact microstrips 10*a*, 10*b*, 10*c* and 10*d*, as well as 11 and 12*a* and 12*b* of dipoles 8*a* and 8*b* are typically etched on thin substrate 17. This substrate, in turn, is mounted on composite substrate 18, which may be fabricated in accordance with U.S. Pat. No. 5,563,616. Composite substrate 18 includes values of relative permittivity and relative permeability that are matched at the mid-band frequency of operation and achieves a free-space characteristic impedance of approximately 377 ohms. This impedance minimizes transitional reflective losses. The composite substrate forms a layer that is approximately 1/16 of a wavelength thick and presents an effective dielectric constant of approximately 10. Higher dielectric-constant materials may be impractical, because of the difficulty in providing a low-loss magnetic equivalent.

The next layer, designated as dielectric substrate 19, includes dielectric material with a dielectric constant value of 98. Dielectric substrate 19 is approximately 3/16 wavelengths thick. The combined substrates, namely composite substrate 18 and dielectric substrate 19, form a thickness of approximately 1/4 of a wavelength. This combination yields an approximate depth reduction ratio of 6.6. Thus, for example, at 1 GHz the combined substrate thickness may be reduced from 2.95 inches to 0.45 inches, and at 100 MHz the thickness may be 4.5 inches instead of 29.5 inches.

Launch points 13 and 14 of dipole microstrips 10*a* and 10*b* are connected, respectively, to transmission feed lines 21 and 22, as shown in FIG. 2. Similarly, the launch points (not labeled) of dipole microstrips 10*c* and 10*d* are connected, respectively, to transmission feed lines 23 and 24. Center conductors 21*a* and 22*a* of transmission feed lines 21 and 22 are connected, respectively, to microstrips 10*a* and 10*b* at launch points 13 and 14. Similarly, center conductors 23*a* and 24*a* of transmission feed lines 23 and 24 are connected, respectively, to microstrips 10*c* and 10*d* at their respective launch points (not labeled).

It will be appreciated that the outer ground conductors (not labeled) of transmission feed lines 21, 22, 23 and 24 may be electrically connected to ground plane 20. The center conductors 21*a*, 22*a*, 23*a* and 24*a* pass through via holes (not labeled) in layers 18, 19 and 20 for eventual connections to dipole microstrips 10*a*, 10*b*, 10*c* and 10*d*, respectively.

It will be understood that transmission feed lines 21, 22, 23 and 24 provide an interface to dipole microstrips 10*a*, 10*b*, 10*c* and 10*d* in pairs to receive/transmit channels for RF processing, as will be described later. These transmission feed lines may be either individual coaxial cables or twin-wire structures, as described in co-pending patent application Ser. No. 10/323,261 by the same inventor. Co-pending patent application Ser. No. 10/323,261 is incorporated herein by reference in its entirety, particularly with respect to its descriptions of twin-wire transmission lines.

Referring again to FIG. 1, phased array antenna 6 is shown as having four orthogonal pairs of radiating elements 8. Although four orthogonal pairs of radiating elements are shown, the invention may be configured to include more or less orthogonal pairs than those four orthogonal pairs shown in FIG. 1. Moreover, generally each orthogonal pair of radiating elements includes two dipoles. Each dipole is generally excited in a balanced mode, at feed points or launch points 13 and 14.

Exemplary approximate dimensions of the planar microstrips shown in FIG. 1 will now be provided. As shown, the width of each dipole microstrip is 0.2 λ. The width of each parallel microstrip is 0.04 λ. The horizontal distance between one launch point of a dipole and another launch point of a horizontally adjacent dipole is 0.5 λ. The vertical distance between two opposing top loading microstrips of a dipole is 0.5 λ. The horizontal length of a top loading microstrip, when spanning between two parallel microstrips, is 0.49 λ.

Figure 3:
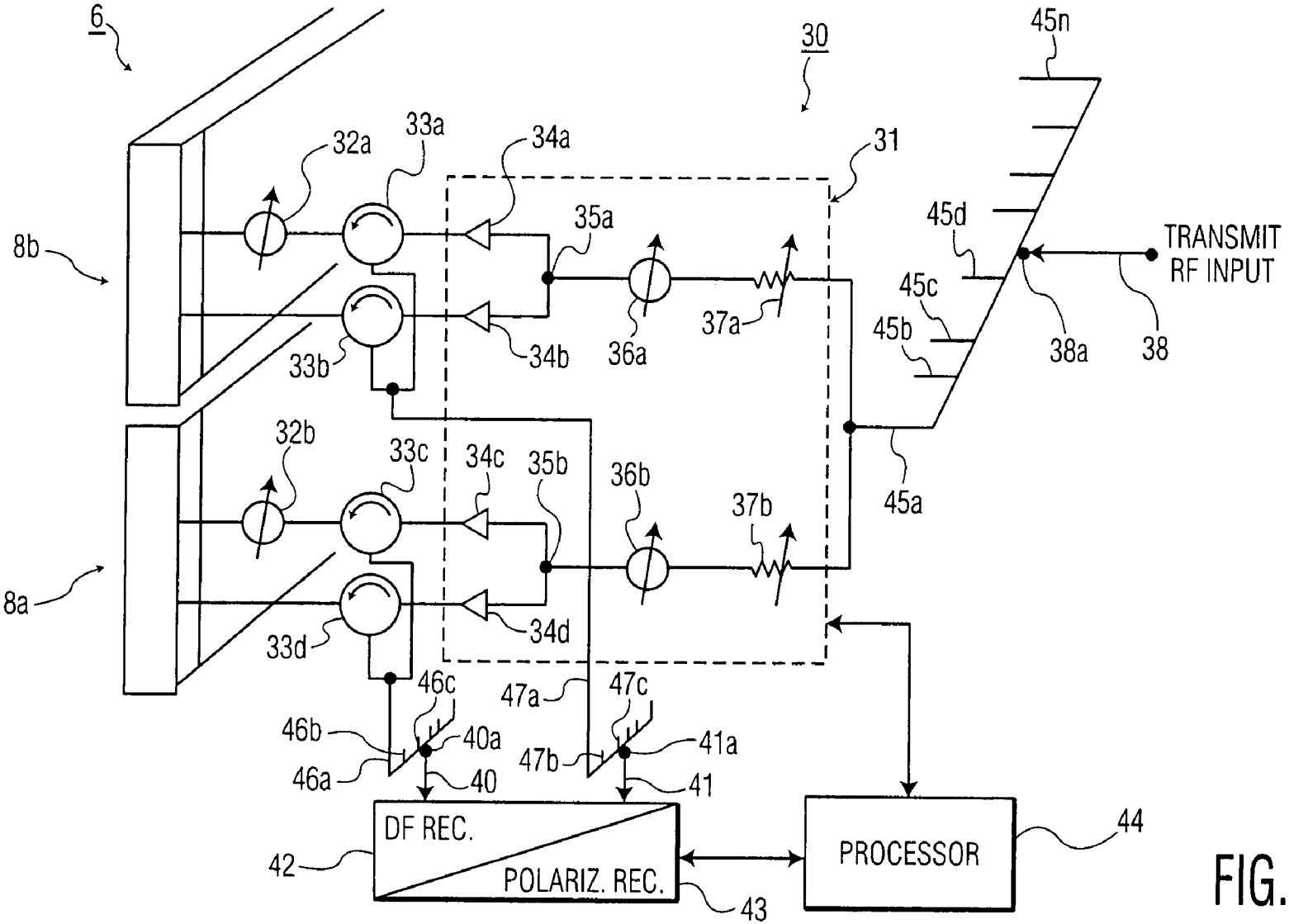
FIG. 3 is a block diagram showing a transmit/receive network for use with the planar phased array of FIG. 1, according to an embodiment of the present invention.
Figure 4:
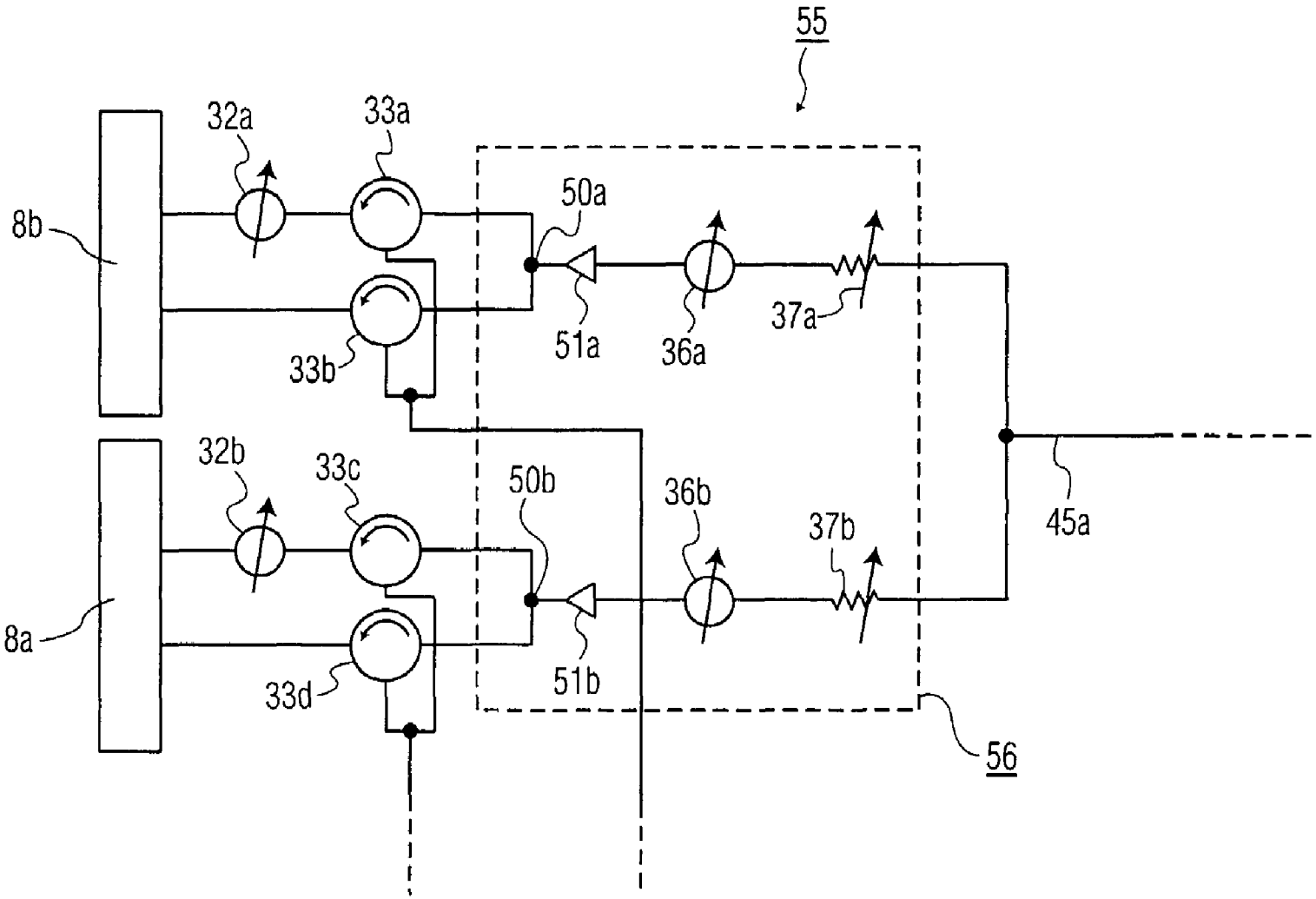
FIG. 4 is a block diagram showing another transmit/receive network for use with the planar phased array of FIG. 1, according to an embodiment of the present invention.
Figure 5:
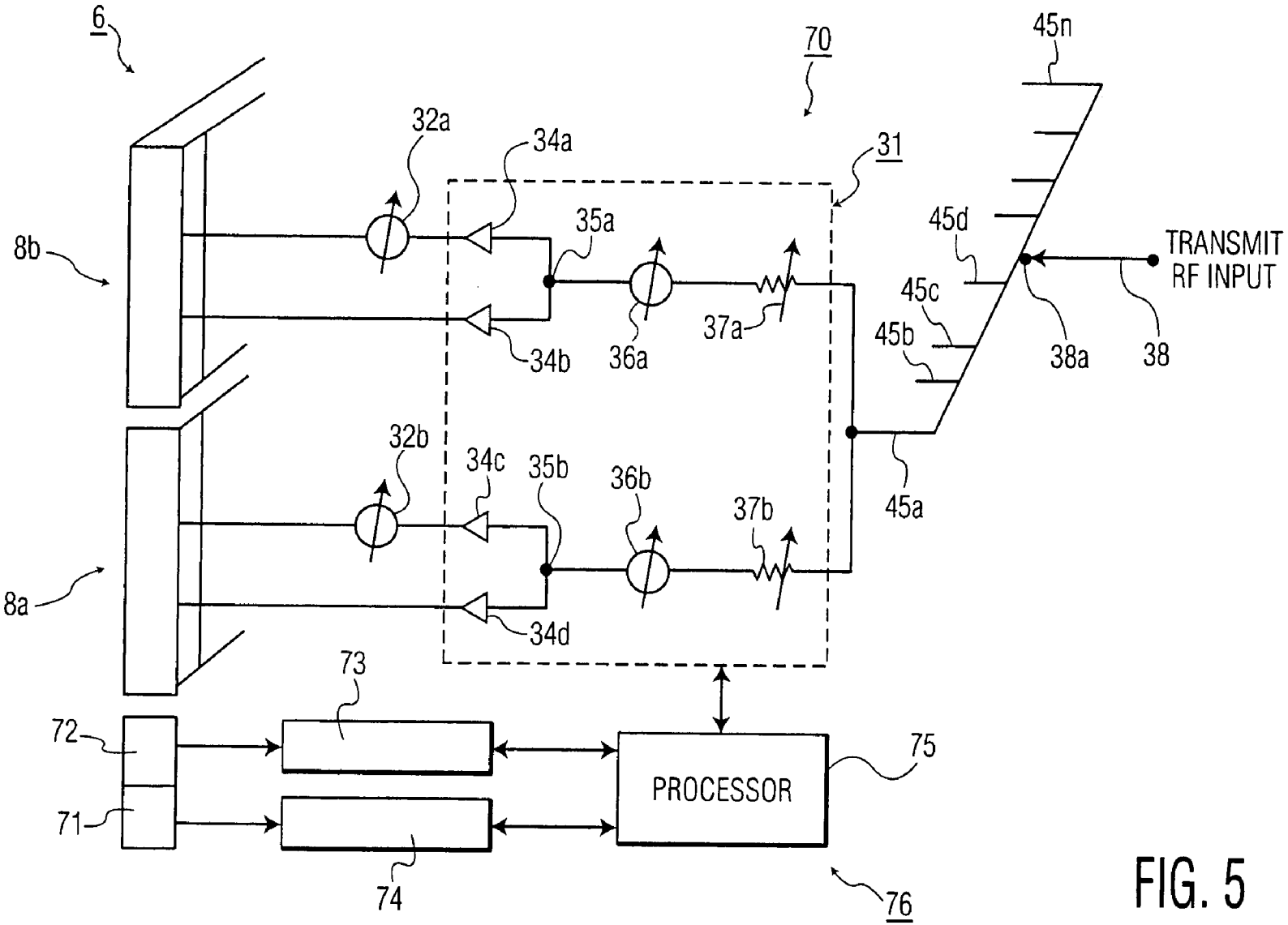
FIG. 5 is a block diagram showing still another transmit/receive network for use with the planar phased array of FIG. 1, according to an embodiment of the present invention.

A discussion will now be directed to RF networks for driving the phased array antenna of FIG. 1, as exemplified in FIGS. 3–5. Referring first to FIG. 3, there is shown a transmit/receive (T/R) network for exciting each dipole of the phased array antenna. The T/R network of FIG. 3 is generally designated as 30 and may be modularly arranged, as shown. Transmit RF input port 38 is divided, at node 38*a*, into multiple array columns, designated 45*a* through 45*n*. Each array column corresponds to an orthogonal pair of radiating elements (only 8*a* and 8*b* are shown). As an example, in one embodiment of the invention, the four orthogonal pairs of radiating elements of FIG. 1 may require four corresponding array columns 45*a*, 45*b* 45*c* and 45*d*. Since each array column includes similar modular components, only the components between array column 45*a* and radiating elements 8*a* and 8*b* (or dipoles 8*a* and 8*b*) will be described below.

Each array column, or more specifically array column 45*a* includes two paths, one path for each dipole. A first path includes variable attenuator 37*a* and variable phase shifter 36*a* connected in series. The attenuator may be used for controlling the transmitted polarization and channel alignment, if necessary. The phase shifter may be used for dual purposes. First, the phase shifter may provide appropriate phase setting for polarization. Second, the phase shifter may provide array beam steering. As will be explained, processor 44 controls both the phase setting of the phase shifter and the attenuation setting of the attenuator.

As shown, a power divider at node 35*a* splits the transmitted signal into two power amplifiers 34*a* and 34*b*. In this manner, each power amplifier energizes a respective feed point of dipole 8*a*. This is a preferred method of powering the phased array antenna instead of using a single amplifier 51 (shown in FIG. 4). The advantage is derived from the separation of the two amplifiers results in a lower heat density.

The output signal of power amplifier 34*a*, after passing through circulator 33*a* and 180 degree phase shifter 32*a*, excites dipole 8*b*. The output signal of power amplifier 34*b* passes through circulator 33*b* and then directly excites dipole 8*b*. The two signals are 180 degrees out-of-phase, which assures proper phase excitation at launch points 13 and 14 (FIG. 1) of dipole 8*b*.

The second path includes variable attenuator 37*b* and variable phase shifter 36*b* connected in series. The attenuator may be used for controlling the transmitted polarization and channel alignment, if necessary. The phase shifter may be used for providing appropriate phase setting for polarization and array beam steering. Processor 44 may control both the phase shifter and the attenuator.

A power divider at node 35*b* splits the transmitted signal into two power amplifiers 34*c* and 34*d*. In this manner, each power amplifier energizes each feed point of dipole 8*a*. The output signal of power amplifier 34*c* passes through circulator 33*c* and 180 degree phase shifter 32*b* and then excites dipole 8*a*. The output signal of power amplifier 34*d* passes through circulator 33*d* and then directly excites dipole 8*a*. The two signals are 180 degrees out-of-phase which assures proper phase excitation of launch points 13 and 14 (FIG. 1) of dipole 8*a*.

In the example shown in FIG. 3, transmit module 31 includes attenuators 37*a* and 37*b*, phase shifters 36*a* and 36*b*, power dividers 35*a* and 35*b*, power amplifiers 34*a*, 34*b*, 34*c* and 34*d*. Although not shown, a similar transmit module 31 may be provided for the other array columns, such as 45*b*, 45*c*, 45*d*, etc.

Operation of T/R network 30 in the receiving mode, as shown in FIG. 3, will now be described. The received signals are sampled by each of the planar compact dipoles 8 of phased array antenna 6, for example dipoles 8*a* and 8*b*. The received signals proceed toward direction finder (DF) receiver 42 and polarization receiver 43 for analysis. The received signals from the compact dipoles are separately combined by combiner 40*a* and combiner 41*a*. Combiner 40*a* combines the signals in receive array columns 46*a*, 46*b*, 46*c*, etc. and outputs the combined signals onto line 40 for input into DF receiver 42 and polarization receiver 43 for analysis. Similarly, combiner 41*a* combines the signals in receive array columns 47*a*, 47*b*, 47*c*, etc. and outputs the combined signals onto line 41 as input to DF receiver 42 and polarization receiver 43 for analysis.

FIG. 3 shows the receive paths between compact dipoles 8*a* and 8*b* and receive array columns 46*a* and 47*a*, respectively. The other receive paths between the other compact dipoles and the other receive array columns are similar and have been omitted in FIG. 3 for purpose of clarity.

Following the receive signals from the upper transmission line (launch points 13 and 14 of dipole 8*b* shown in FIG. 1), one feed point requires a 180 degree phase shifter 32*a* to assure that the dipole excitation is properly phased. The two signal paths of dipole 8*b* pass through circulators 33*a* and 33*b*, and are combined at receive array column 47*a*. Similarly, the lower transmission line (launch points 13 and 14 of dipole 8*a* shown in FIG. 1) has one feed point passing through a 180 degree phase shifter 32*b* and circulator 33*c*, while the other feed point passes through circulator 33*d*. The two signal paths of dipole 8*a* are combined at receive array column 46*a*.

It will be appreciated that circulators 33*a*, 33*b*, 33*c* and 33*d* may not provide sufficient isolation between the received and transmitted signals and may require either a limiter or a switch, or both, immediately after each circulator. These signals are combined into lines 40 and 41 by combiners 40*a* and 41*a*. Combiner 40*a* represents right slant-linear polarization and combiner 41*a* represents left-slant linear polarization. These two channels are processed in DF receiver 42 to determine direction of arrival of the signal under analysis and, simultaneously, are analyzed in polarization receiver 43 for polarization, using techniques described in U.S. Pat. No. 5,933,108. The derived results are handed over to system processor 44 for controlling the transmit channels. The polarization techniques described in U.S. Pat. No. 5,933,108, are incorporated herein by reference in their entirety. As described therein, a vector controller includes receive ports for determining the incoming polarization of a received signal, and includes output ports for controlling the amplitude and phase of a transmitted signal.

It will be appreciated that the phased array antenna, when processed via a polarization control network, such as network 30, has full polarization capability. The polarization may be controlled by open-loop methods or closed loop, adaptive methods. The closed loop, adaptive methods may encompass all linear polarizations and right or left hand circular polarizations. Open loop methods, however, may typically include six polarizations, namely vertical, horizontal, left slant-linear, right slant-linear, right-hand circular and left-hand circular.

Referring next to FIG. 4, there is shown an alternative transmit/receive (T/R) network, generally designated as 55. Network 55 is similar to T/R network 30 shown in FIG. 3. The receive paths are similar to the receive paths of T/R network and are not shown in FIG. 4. Only the transmit paths between array column 45*a* and dipoles 8*a* and 8*b* are shown in FIG. 4.

A difference between T/R network 55 and T/R network 30 will now be described by referring to transmit module 56 of FIG. 4. Shown as an example, transmit module 56 includes attenuators 37*a* and 37*b*, phase shifters 36*a* and 36*b* and single power amplifiers 51*a* and 51*b*. The output signal of amplifier 51*a* is split by power divider 50*a* and sent to circulators 33*a* and 33*b*. Similarly, the output signal of amplifier 51*b* is split by power divider 50*b* and sent to circulators 33*c* and 33*d*. The other components shown in FIG. 4 are similar to corresponding components shown in FIG. 3. A disadvantage of using a single amplifier, such as 51*a* and 51*b*, is that a single amplifier must dissipate more heat than two separate amplifiers, such as amplifiers 34*a*, 34*b* or amplifiers 34*c*, 34*d*, used in transmit module 31 of FIG. 3.

FIG. 5 illustrates a T/R network having a separate transmit module and a separate receive module, generally designated as 70. Receive module 76 may use the inventive phased array antenna or may use other sensors to provide DF and polarization inputs. As shown, receive module 76, of which only one receive array column is shown, includes antenna dipoles 71 and 72 connected to DF/polarization receivers 73 and 74. The outputs from DF/polarization receivers 73 and 74 are sent to processor 75.

Processor 75 may control the amplitude and phase of transmit module 31, as previously described. Transmit module 31 includes the same components as those shown in FIG. 3. Only one transmit module is shown. The other transmit modules have been omitted for clarity purpose.

It will be appreciated that a difference in T/R network 70, as compared to T/R network 30, is the elimination of the entire receive path including circulators 33*a*, 33*b*, 33*c* and 33*d*.

It will be further appreciated that the receive array size (number of columns) is determined by sensitivity requirements and does not need to be equal to the size of the transmit array.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A phased array antenna comprising:

a plurality of radiating elements arranged as orthogonal pairs in a herringbone pattern, and each radiating element includes multiple microstrips disposed conformally on a planar substrate, wherein each radiating element includes a dipole formed as a pair of dipole microstrips extending from a pair of launch points.

2. The antenna of claim 1 wherein each dipole microstrip of the pair of dipole microstrips extends between one launch point of the pair of launch points and a top loading microstrip, and the top loading microstrip provides a capacitive load to the dipole.

3. The antenna of claim 2 wherein the top loading microstrip extends between parallel microstrips for providing an additional capacitive load to the dipole, and the pair of dipole microstrips are oriented substantially parallel and sandwiched between the parallel microstrips.

4. The antenna of claim 1 wherein each of the radiating elements is oriented approximately 45 degrees relative to an array scan axis.

5. The antenna of claim 1 wherein the multiple microstrips are disposed approximately one-quarter wavelength above a ground plane.

6. The antenna of claim 1 wherein the planar substrate is mounted on a composite substrate having a permittivity and permeability matched at a mid-band frequency of operation to achieve an impedance of approximately 377 ohms.

7. The antenna of claim 6 wherein the composite substrate is approximately 1/16 of a wavelength in thickness.

8. The antenna of claim 6 wherein the composite substrate is formed from a compound having electrical and magnetic properties.

9. The antenna of claim 6 wherein the composite substrate includes an effective dielectric constant of approximately 10.

10. The antenna of claim 6 wherein the composite substrate is mounted on a dielectric substrate having a dielectric constant value of approximately 98.

11. The antenna of claim 10 wherein the dielectric substrate is approximately 3/16 of a wavelength in thickness.

12. The antenna of claim 10 wherein both the dielectric substrate and the composite substrate have an approximate thickness of 1/4 of a wavelength and yield an approximate thickness reduction ratio of 6.6 to 1.

13. The antenna of claim 1 wherein the multiple microstrips are formed by etching the planar substrate.

14. The antenna of claim 1 wherein the multiple microstrips are formed by depositing metallic strips on the planar substrate.

15. The antenna of claim 1 wherein the multiple microstrips are arranged to form a current sheet for an aperture of the phased array antenna.

16. The antenna of claim 1 wherein the radiating elements are arranged to provide mutual coupling to each other to extend operation at a low end of the frequency band.

17. The antenna of claim 1 wherein each radiating element is excited by a balanced transmission line.

18. The antenna of claim 1 wherein each radiating element is connected to a transmit/receive network for varying the amplitude and phase of a transmitted signal.

19. The antenna of claim 18 wherein the transmit/receive network includes a receiver for determining direction and phase of a received signal, and a processor for controlling the amplitude and phase of the transmitted signal based on the direction and phase of the received signal.

20. An antenna system comprising:

a phased array formed of a plurality of radiating elements arranged in a herringbone pattern, wherein the radiating elements are formed of multiple microstrips disposed conformally on a planar substrate, and, each radiating element includes a dipole formed as a pair of dipole microstrips extending from a pair of launch points, and a transmit/receive network connected to the radiating elements for varying the amplitude and phase of a transmitted signal.

21. The antenna system of claim 20 wherein the transmit/receive network includes a receiver for determining direction and phase of a received signal, and a processor for controlling the amplitude and phase of the transmitted signal based on the direction and phase of the received signal.

22. The antenna system of claim 20 wherein the transmit/receive network includes an array of modular transmitters for exciting a corresponding array of the radiating elements.

23. A method of making a phased array antenna comprising the steps of:

(a) conformally forming multiple microstrips on a planar substrate, (b) arranging the multiple microstrips in a herringbone pattern to form a plurality of radiating elements, wherein each radiating element includes a dipole formed as a pair of dipole microstrips extending from a pair of launch points, and (c) placing the multiple microstrips of the planar substrate approximately one quarter of a wavelength above a ground plane.

24. The method of claim 23 including the step of:

placing a composite substrate and a dielectric substrate between the planar substrate and the ground plane, wherein the composite substrate has an effective dielectric constant of approximately 10 and the dielectric substrate has an effective dielectric constant of approximately 98.

25. The method of claim 24 wherein the composite substrate is made approximately 1/16 of a wavelength in thickness, and the dielectric substrate is made approximately 3/16 of a wavelength in thickness.

* * * * *